US005860607A

United States Patent [19]

Irwin

[11] Patent Number: 5,860,607

[45] Date of Patent: Jan. 19, 1999

[54] APPARATUS FOR COMMINUTING WASTE MATERIALS HAVING SCREW DELIVERY FEATURES

[75] Inventor: Jere F. Irwin, Yakima, Wash.

[73] Assignee: Irwin Research & Development, Inc., Yakima, Wash.

[21] Appl. No.: 780,224

[22] Filed: Jan. 8, 1997

[51] Int. Cl.[6] ..... B02C 18/22

[52] U.S. Cl. ..... 241/80; 241/222; 241/225; 241/236

[58] Field of Search ..... 241/222, 225, 241/236, 186.5, 80, 97, 224

[56] References Cited

U.S. PATENT DOCUMENTS

| | | | |
|---|---|---|---|
| 2,595,117 | 4/1952 | Ahlmann . | |
| 3,055,597 | 9/1962 | Mund . | |
| 3,229,698 | 1/1966 | Johansson et al. . | |
| 3,310,059 | 3/1967 | Grinzinger . | |
| 3,627,211 | 12/1971 | Leach . | |
| 4,161,296 | 7/1979 | Parker et al. | 241/222 |
| 4,321,027 | 3/1982 | Stoehr et al. | 241/222 |
| 4,355,766 | 10/1982 | Wigand | 241/222 |
| 4,422,581 | 12/1983 | Chryst | 241/222 |
| 4,687,144 | 8/1987 | Irwin et al. . | |
| 5,039,020 | 8/1991 | Leuhold et al. . | |
| 5,141,168 | 8/1992 | Pepper . | |

FOREIGN PATENT DOCUMENTS

| | | | |
|---|---|---|---|
| 3614028 | 10/1987 | Germany | 241/225 |
| 1556745 | 4/1990 | U.S.S.R. | 241/222 |
| WO 95/33566 | 12/1995 | WIPO . | |

*Primary Examiner*—Mark Rosenbaum
*Attorney, Agent, or Firm*—Wells, St. John, Roberts, Gregory & Matkin, P.S

[57] ABSTRACT

An improved apparatus for comminuting solid waste material into small pieces having a size less than a predetermined size is disclosed. A set of overlapping scissor rolls are rotatably mounted within an enclosure for shearing the waste material into subdivided pieces when the material passes between the scissor rolls. An entrance for receiving the material has: (1) a shear intake manifold communicating with the entrance for receiving the solid waste material upstream of the scissor rolls and directing the waste material to the scissor rolls, and (2) a shear outtake manifold downstream of the scissor rolls for receiving the subdivided waste material pieces from the scissor rolls after the material has passed between the scissor rolls. A feed roll is carried by the frame for feeding the waste material into the shear intake manifold at a desired line speed and directing the waste material to the scissor rolls. A separator screen separates large and small subdivided pieces. A pneumatic conveyor is used to deliver the subdivided pieces within and from the apparatus. Another version includes a screw conveyor operating as an Archimedes screw for delivering the subdivided pieces of comminuted material.

15 Claims, 12 Drawing Sheets

137
136

139
150
133
134
120
135
126
118
124
122
12
12
116
131
114
112

128
112

116
124
122
118
126
126
135
120
133
114

APPARATUS FOR COMMINUTING WASTE MATERIALS HAVING SCREW DELIVERY FEATURES

TECHNICAL FIELD

This invention relates to apparatus for comminuting solid waste materials such as plastic sheet material.

BACKGROUND OF THE INVENTION

During the manufacture and forming of many products from plastic, significant amounts of plastic waste material are frequently produced. Applicant has previously invented several unique apparatus for comminuting waste material, particularly plastic sheet material, into small, rather uniform particles or pieces that can be readily recycled or disposed of in an environmentally acceptable manner. One such prior invention is the subject of the Irwin, et al., U.S. Pat. No. 4,687,144 granted Aug. 18, 1987 and assigned to Irwin Research and Development, Inc. Another such prior invention directed to an improved device is the subject of Patent Cooperation Treaty (PCT) International Application PCT/US94106412 published on 14 Dec. 1995, having International Publication No. WO 95/33566, and listing as Applicants (for all designated states except U.S.) Irwin Research and Development, Inc. The first prior invention of U.S. Pat. No. 4,687,144 was a vast improvement over various types of hammermills that had previously been used. The hammermills were quite bulky, extremely noisy, and prone to substantial damage when the mill received foreign material that it could not comminute. Although such prior Irwin, et al, invention was a vast improvement and was commercially successful, particularly in view of hammermills, it was rather expensive to manufacture and sometimes noisy in operation when processing certain materials. Furthermore, it was unable to satisfactorily comminute rather high density plastic materials.

The improved prior invention of PCT Application No. PCT/U.S. 94/06412 was an improvement over the invention of U.S. Pat. No. 4,687,144. More particularly, an improved comminuting apparatus is taught which is able to produce significantly greater amounts of comminuted material in a given time. Furthermore, such device is less expensive to manufacture and quieter in operation. Even further, the apparatus provides an ability to comminute a wider variety of solid waste products. More particularly, the solid waste comminuting apparatus carries material that is severed in the device via an airstream to a fan. Subdivided pieces of material are directed via the fan to a separator screen which is mounted within a centrifugal housing. The airstream carries small pieces through the separator screen into an outer volute chamber for discharge from the apparatus. Large pieces which are not capable of passing through the separator screen are recycled through a recycle outlet and a recycle conduit back to scissor rolls of the device for further size reduction.

The object of the present invention is to provide a vastly improved comminuting apparatus that is not only able to process significantly greater amounts of material in a given time, it is better able to recirculate severed solid waste material for sorting in the separator screen. It is also better able to sever the material at a desired speed, or line speed in a feed-controlled manner from a web of material being received from a processing machine. Accordingly, the present invention provides an apparatus that is able to feed solid waste material into the comminuting apparatus in a speed-controlled manner.

BRIEF DESCRIPTION OF THE DRAWINGS

Preferred embodiments of the invention are described below with reference to the accompanying drawings, which are briefly described below.

FIG. 7 is a series of illustration views of the waste material and the reduction of the waste material into smaller and smaller particles of the material as it is progressively processed and reduced to a desired particulate size;

FIG. 13 is a fragmentary elevational view taken along line 13—13 in FIG. 9 of an inner portion with a front wall removed to illustrate scissor rolls emphasizing the location and spacing of scissor roll ring finger knives but with the feed gears removed to facilitate viewing; and FIG. 14 is a fragmentary view taken along line 14—14 in FIG. 10 of an inner portion taken from within an intake manifold section with a divider wall removed to illustrate interaction of feed gears on the servo feed roll with a feed plate but with the scissor rolls removed to facilitate viewing.

DETAILED DESCRIPTION OF THE PREFERRED EMBODIMENTS

Figure 1:
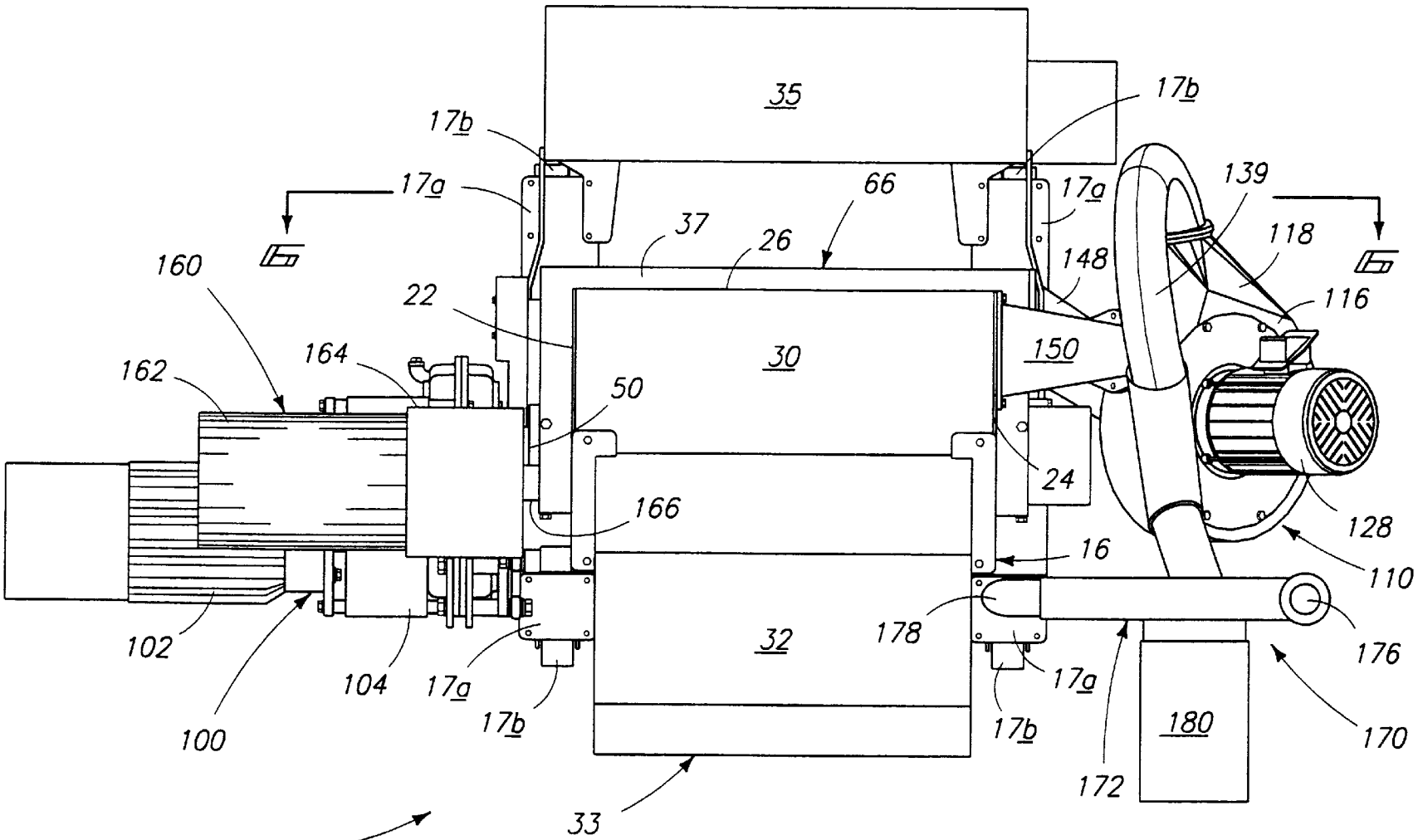
FIG. 1 is a plan view of a preferred embodiment of the apparatus illustrating the top exterior of the apparatus with a waste material entrance.

This disclosure of the invention is submitted in furtherance of the constitutional purposes of the U.S. Patent Laws "to promote the progress of science and useful arts" (Article 1, Section 8).

According to one aspect of this invention, an improved apparatus for comminuting solid waste material into small pieces having a size less than a predetermined size is disclosed. The apparatus includes a frame having an enclosure with an entrance for initially receiving the solid waste material. A set of overlapping scissor rolls rotatably mount within the enclosure for shearing the waste material into subdivided pieces when the material passes between the scissor rolls. The entrance has: (1) a shear intake manifold communicating with the entrance for receiving the solid waste material upstream of the scissor rolls and directing the waste material to the scissor rolls, and (2) a shear outtake manifold downstream of the scissor rolls for receiving the subdivided waste material pieces from the scissor rolls after the material has passed between the scissor rolls. A feed roll is rotatably carried by the frame for feeding the waste material into the shear intake manifold at a desired line speed and directing the waste material to the scissor rolls. A separator screen is mounted on the frame downstream of the scissor rolls having a plurality of apertures corresponding to the predetermined size for permitting small subdivided pieces having a size less than the predetermined size to pass therethrough while preventing large subdivided pieces having a size greater than the predetermined size from passing therethrough. A pneumatic conveyor is mounted on the frame communicating with the shear outtake manifold, the screen, and the shear intake manifold for generating an airstream of sufficient velocity to: (1) remove the subdivided pieces from the shear outtake manifold, (2) entrain the subdivided pieces in the airstream, (3) impinge the subdivided pieces against the screen to direct the small subdivided pieces through the screen, and (4) carrying the large subdivided pieces away from the screen and into the shear intake manifold to recycle the large subdivided pieces through the scissor rolls to further reduce the size of the large subdivided pieces.

According to another aspect of this invention, an improved apparatus for comminuting solid waste material into small pieces having a size less than a predetermined size is disclosed. The apparatus includes a frame having an enclosure with an entrance for initially receiving the solid waste material. A set of overlapping scissor rolls rotatably mount within the enclosure for shearing the waste material into subdivided pieces when the material passes between the scissor rolls. The entrance has: (1) a shear intake manifold communicating with the entrance for receiving the solid waste material upstream of the scissor rolls and directing the waste material to the scissor rolls, and (2) a shear outtake manifold downstream of the scissor rolls for receiving the subdivided waste material pieces from the scissor rolls after the material has passed between the scissor rolls. A separator screen is mounted on the frame downstream of the scissor rolls having a plurality of apertures corresponding to the predetermined size for permitting small subdivided pieces having a size less than the predetermined size to pass therethrough while preventing large subdivided pieces having a size greater than the predetermined size from passing therethrough. A pneumatic conveyor is mounted on the frame communicating with the shear outtake manifold, the screen, and the shear intake manifold for generating an airstream of sufficient velocity to: (1) remove the subdivided pieces from the shear outtake manifold, (2) entrain the subdivided pieces in the airstream, (3) impinge the subdivided pieces against the screen to direct the small subdivided pieces through the screen, and (4) carrying the large subdivided pieces away from the screen and into the shear intake manifold to recycle the large subdivided pieces through the scissor rolls to further reduce the size of the large subdivided pieces. A screw conveyor is also included in the apparatus for delivering subdivided pieces from the shear outtake manifold to the pneumatic conveyor.

A preferred embodiment of the invention is illustrated in the accompanying drawings particularly showing a waste comminuting apparatus generally designated with the numeral 10 in FIGS. 1–5 for receiving solid waste material 12 and for reducing the solid waste material progressively into smaller and smaller sizes until the desired small particulate or piece size is obtained as illustrated in FIG. 7.

It should be noted that the apparatus 10 is very compact even though the material is progressively reduced in size in several stages to a desired predetermined small size. The predetermined small piece size will generally depend upon the desires of the customer, the end use, and the particular material being comminuted. The solid waste material 12, illustrated in FIG. 7, is progressively reduced to subdivided pieces 14*a* through 14*e*. When the subdivided pieces are generally reduced to the desired small size, 14*e*, they are removed from the apparatus as the final product. Those subdivided pieces that have not been sufficiently reduced to the desired small size are reprocessed or recycled until they are sufficiently reduced to the desired size.

The apparatus 10 has a general frame 16 that may be self-supported or affixed to other apparatus such as the discharge of a thermal-forming machine for receiving the solid waste material 12 directly from a thermal-forming machine and reducing the material for re-use. Frame 16 generally includes a general enclosure 18 that includes a front wall 20; side walls 22, 24; back wall 26; a bottom wall 28, and a top wall 30. Top wall 30 has a material receiving duct 32 having a material entrance 33 (see FIGS. 1–3 and 5) through which the solid waste material is fed into apparatus 10. General frame 16 may be supported on legs 17*a* that have wheels 17*b*. General frame 16 preferably includes walls 20–30 and lower frame members 38 and 40 that are variously illustrated in FIGS. 1–5.

Within the enclosure 18, two scissor rolls 42 and 44 are mounted in an intermeshing relationship for rotation in opposite directions in coordination with each other to receive the solid waste material 12 and to shear the solid material as the material passes between scissor rolls 42 and 44. Scissor rolls 42 and 44 are positioned within enclosure 18 between an intake manifold 46 that receives the material through entrance 32. The material, after passing through the scissor rolls, descends into an outtake manifold 48 (see FIG. 5).

Scissor roll 42 is mounted on a shaft 50 that rotates about axis 52. Scissor roll 44 is mounted on a shaft 54 that rotates about axis 56. Axes 52 and 56 are parallel with each other and extend between the side walls 22 and 24. Axes 52 and 56 are positioned so that scissor rolls 42 and 44 have sufficient overlap to shear the material between the scissor rolls as the material passes between the rolls. Shafts 50 and 54 are supported for rotation by respective bearings 57 (see FIG. 6). Each of shafts 50 and 54 has hexagonal cross-sectional profiles, providing angular drive surfaces 58.

Each of scissor rolls 42 and 44 include a plurality of scissor rings 60 in which each of the rings 60 has an outer circular peripheral surface 62 and an inner hexagonal bearing surface 64 that is complementary to the profile of shafts 50 and 54 so that the scissor rings 60 rotate in response to the rotation of shafts 50 and 54. Each of the scissor rings 60 includes side surfaces that form shearing edges 68 with the outer peripheral surface 62 (see FIG. 13).

Figure 9:
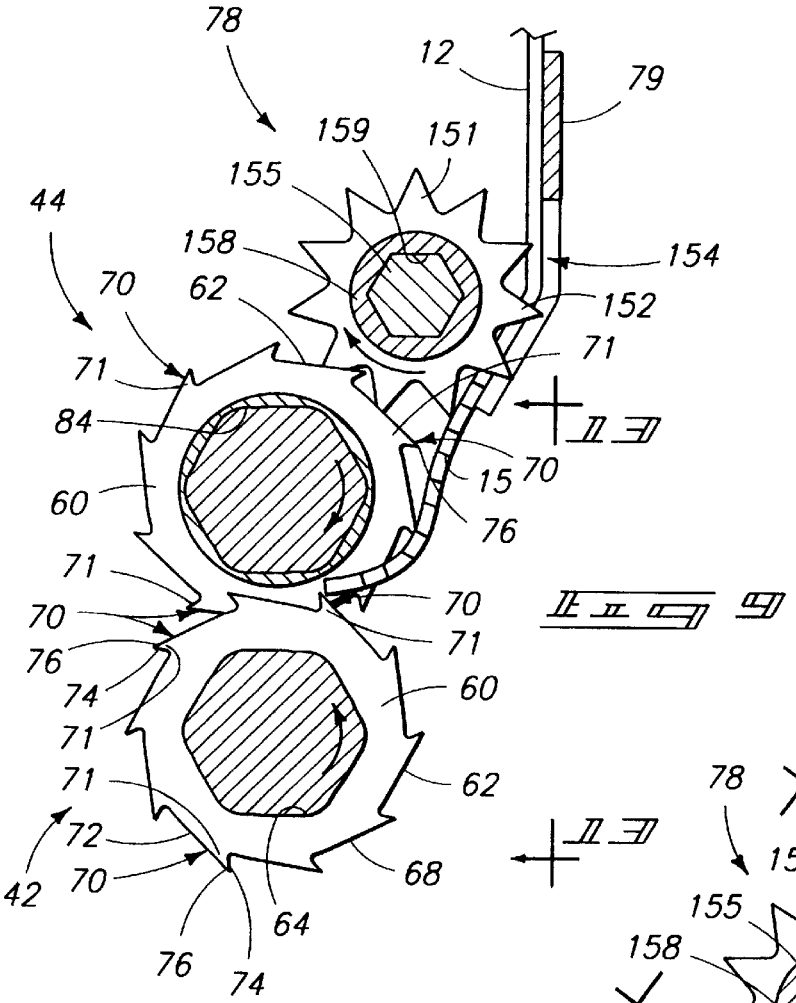
FIG. 9 is an isolated vertical cross-sectional view of a set of scissor roll rings and feed gears on a servo feed roll illustrating the initial entrance and feeding of a piece of waste material between the scissor rolls.
Figure 10:
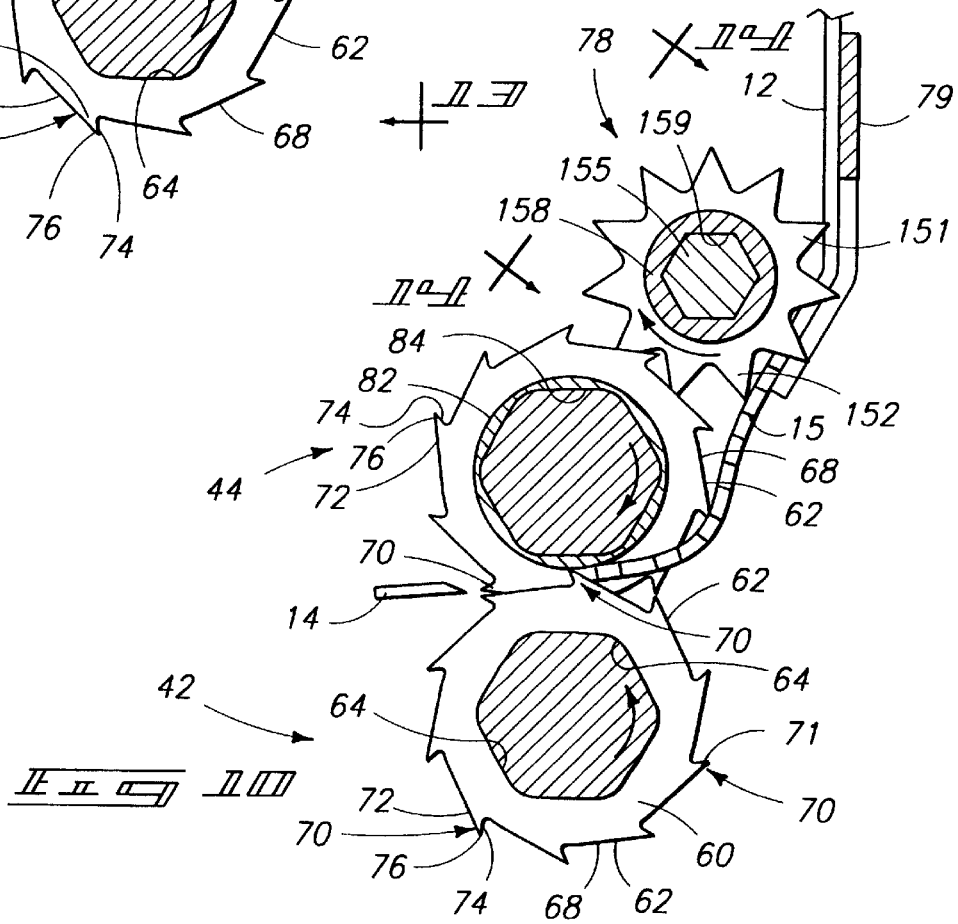
FIG. 10 is an isolated vertical cross-sectional view similar to FIG. 9, except showing the scissor roll rings and feed gears incrementally rotated to feed and sever the piece of waste material.
Figure 11:
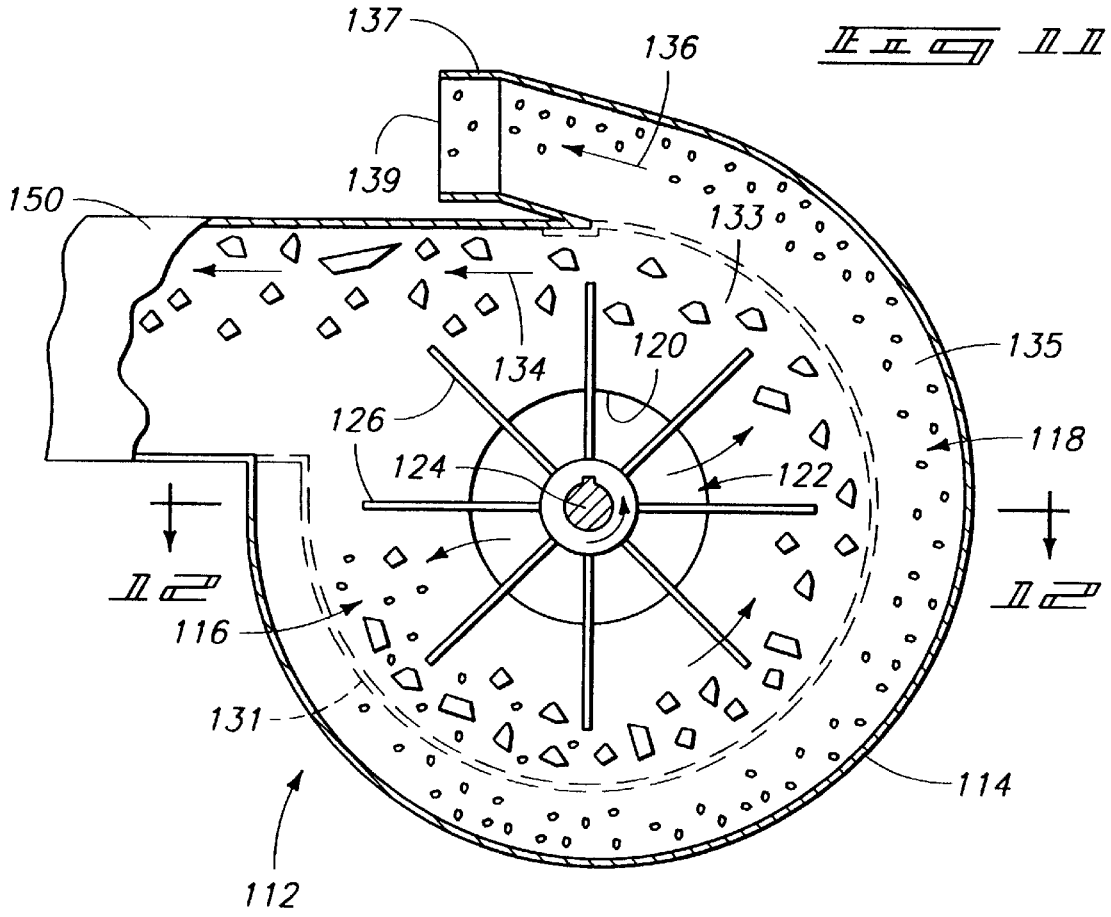

In the preferred embodiment, each of scissor rings 60 have evenly angularly spaced finger knives 70 formed integrally on the scissor rings 60 and projecting radially outward of the surface 62 and forward in the direction of rotation for gripping, puncturing and transversely cutting the solid material 12 as illustrated in FIGS. 9 and 10. Each of the finger knives 70 includes a projecting body 71 that projects radially outward from the peripheral surface 62 and projects forward in the direction of rotation. Each of the finger knives 70 includes a side shearing surface 72 and an undercut surface 74, forming a sharp knife point 76. The scissor ring finger knives 70 are intended to grip, puncture and transverse the cuttage piece as it is being sheared between rings 60.

Each of the scissor rolls 42 and 44 further include a plurality of ring spacers 80. Each spacer 80 has a circular outer peripheral surface 82 and an inner hexagonal surface 84 (see FIGS. 9 and 10). Each of the ring spacers 80 has a width that is slightly greater than the width of the spacer rings 60. Each of the spacer rings 60 and ring spacers 80 are alternately positioned on shafts 50 and 54 so that a scissor ring 70 on one scissor roll opposes a corresponding ring spacer 80 on the other scissor roll, creating a circular inter-roll cavity 86 (see FIG. 13) between the adjacent rings and outward of the intermediate ring spacers 80. Once the material 12 is cut and sheared, it is received in the inter-roll cavity 86 (see FIG. 13) and passes between rolls 42 and 44 into the outtake manifold 48.

The axes 52 and 56 of the rolls are sufficiently spaced so that there is a slight overlap of approximately one-eighth inch (⅛") in the profile of the scissor rings so that as they are rotated, the material is sheared by the shearing edges 68 and the finger knife 70 as a profile of the scissor ring 60 moves into the circular inter-roll cavity 86 of the opposing ring spacer 80 (see FIG. 13).

Figure 5:
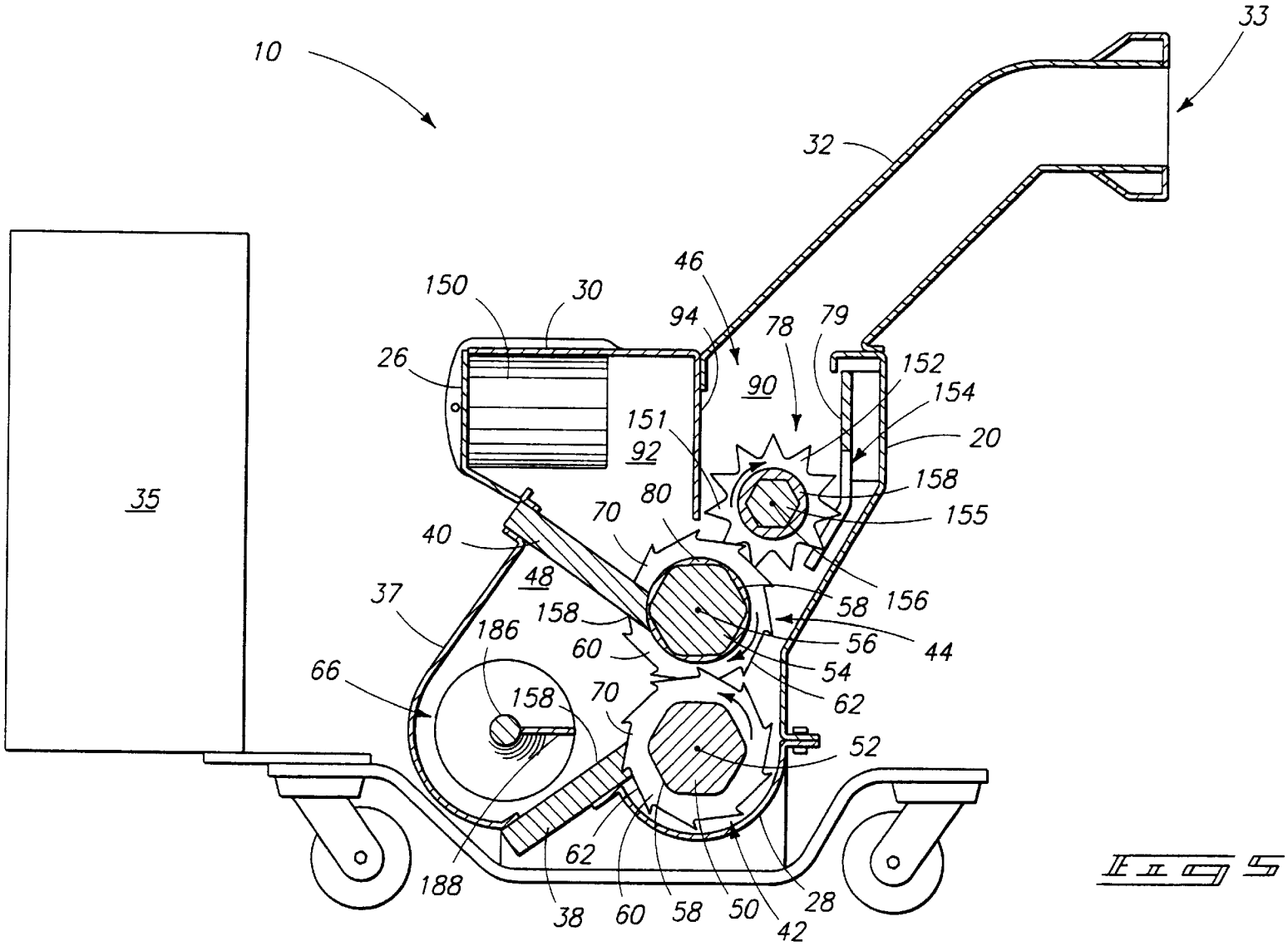
FIG. 5 is a transverse vertical cross-sectional view taken along line 5—5 in FIG. 2 illustrating the interior of the apparatus.
Figure 8:
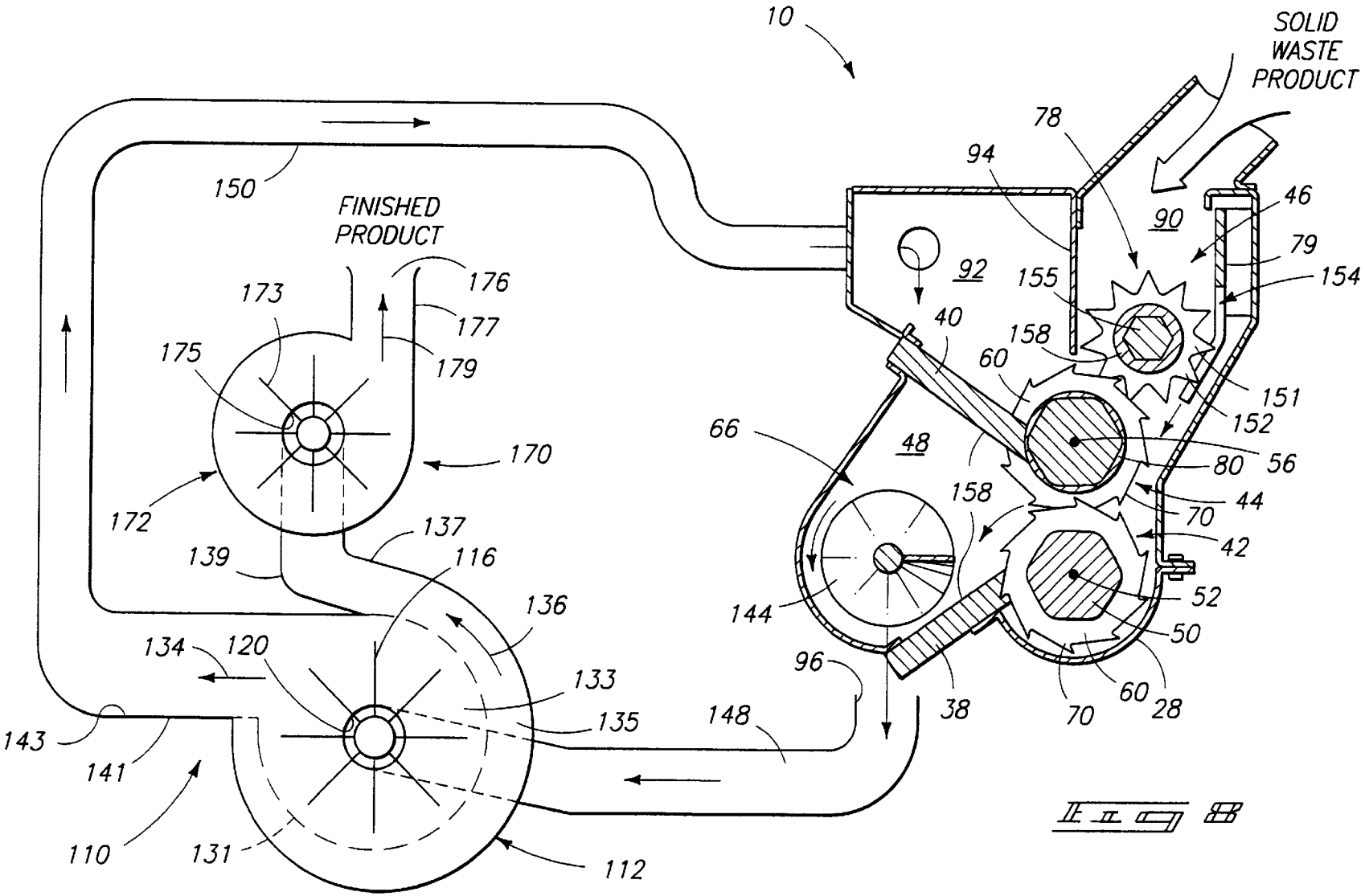
FIG. 8 is a product flow illustrated diagram showing the flow path of the waste material through the apparatus as the material is being progressively processed and reduced to the desired particulate size.

The intake manifold 46 has an entrance intake manifold section 90 and a recycle intake manifold section 92 illustrated in FIGS. 5 and 8. Sections 90 and 92 are separated by a divider 94. New solid waste material 12 enters through the material entrance 33 via the material receiving duct 32 into the entrance intake manifold section 90, and subdivided material requiring additional recycling is recirculated back into the intake manifold section 92.

The outtake manifold 48 includes an outlet 96 (FIGS. 5 and 6) and a feed tray 37 with a screw conveyor 66 to facilitate the removal of the severed pieces from the outtake manifold 48 and to entrain such pieces 14 in an airstream via an outtake pipe 148 and pneumatic conveyor 110. Outtake pipe 148 provides a first airstream conduit for directing an airstream with entrained subdivided pieces from the shear outtake manifold 48 to a separating screen 131 (see FIG. 8).

The apparatus 10 includes a scissor roll drive generally designated with the numeral 100 illustrated in FIGS. 1–4 and 6 having a motor 102 connected to a speed reduction gear box 104. The box 104 is operatively connected to the shafts 50 and 54 for rotating the shafts counter to each other in the directions illustrated in FIGS. 5, 8 and 13.

The apparatus 10 further includes a pneumatic conveyor/separator generally designated with the numeral 110 for conveying the subdivided pieces 14 from the outtake manifold 48 and directing the pieces to a separator screen 131 (see FIG. 8) to impinge the subdivided pieces against the screen 131 to direct small subdivided pieces **14*e* through the screen and to carry large subdivided pieces 14*a*–14*d* back to the shear intake manifold 46 via a recycle intake manifold section 92** to further reduce the size of the large subdivided pieces.

The pneumatic conveyor/separator 110 includes a centrifugal fan 112 for generating an airstream of sufficient velocity and volume to remove the subdivided pieces from the shear outtake manifold 48 with the assistance of screw conveyor 66 and to entrain the pieces **14*a*–14*e* in the airstream (see FIG. 8). The centrifugal fan 112, illustrated in FIGS. 11 and 12, includes a housing 114 having a central propeller section 116 and a peripheral volute section 118. The central propeller section 116 includes a central inlet 120 with a propeller assembly 122 mounted within the central propeller section 116. The propeller assembly 122 includes a shaft 124 with radial blades 126 extending radially outward for directing the air from the central inlet 120 radially outward and tangential into the peripheral volute section 118. A motor 128 is connected to the shaft 124 for rotating the blades 126** at the desired speed to obtain an airstream having the desired velocity and volume.

Figure 11:
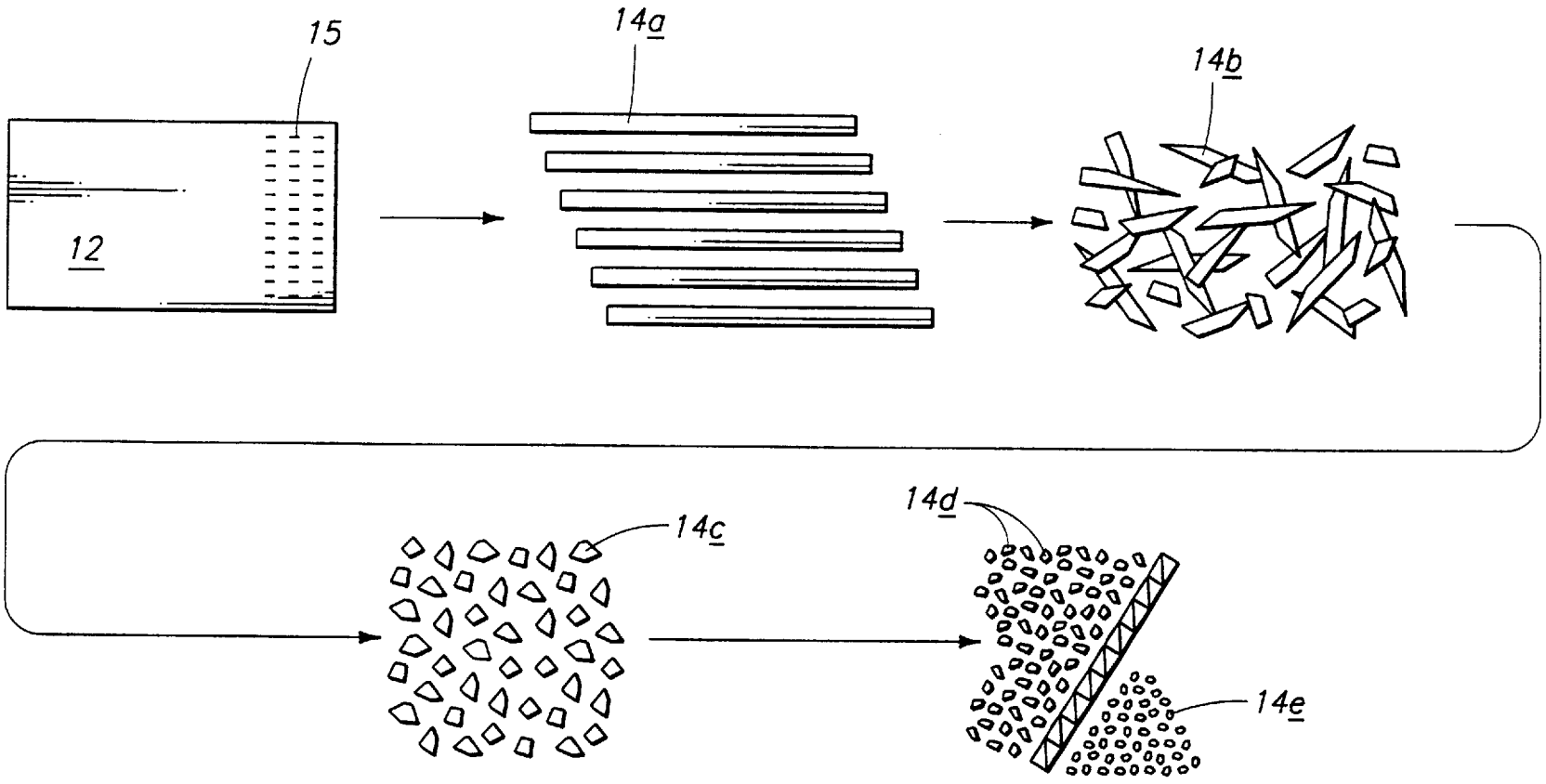
FIG. 11 is a cross-sectional view taken along line 11—11 in FIG. 4.
Figure 12:
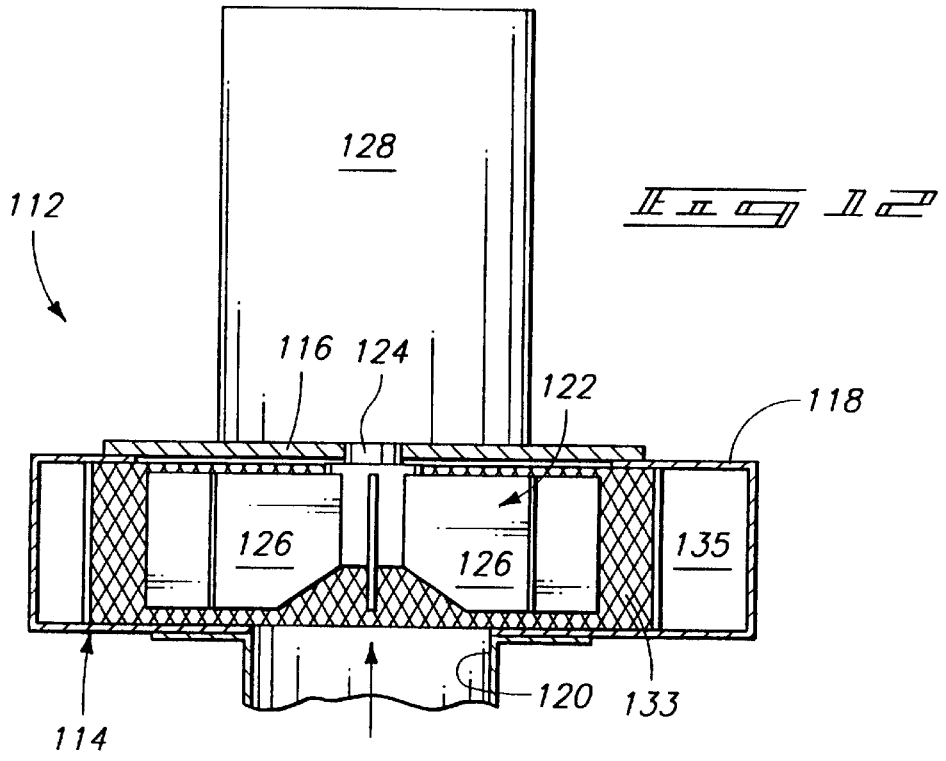
FIG. 12 is a cross-sectional view taken along line 12—12 in FIG. 11.
Figure 11:
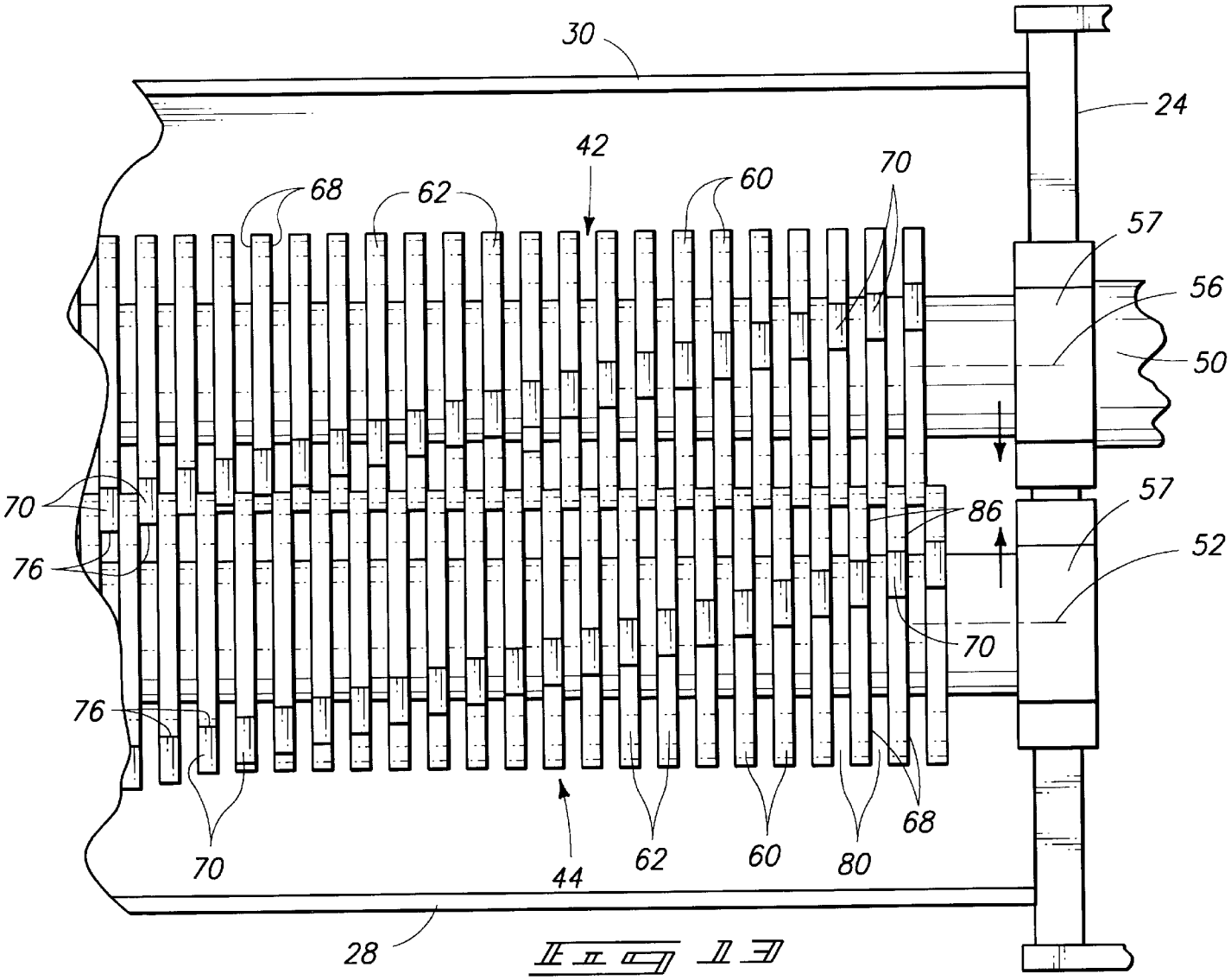
Figure 11:
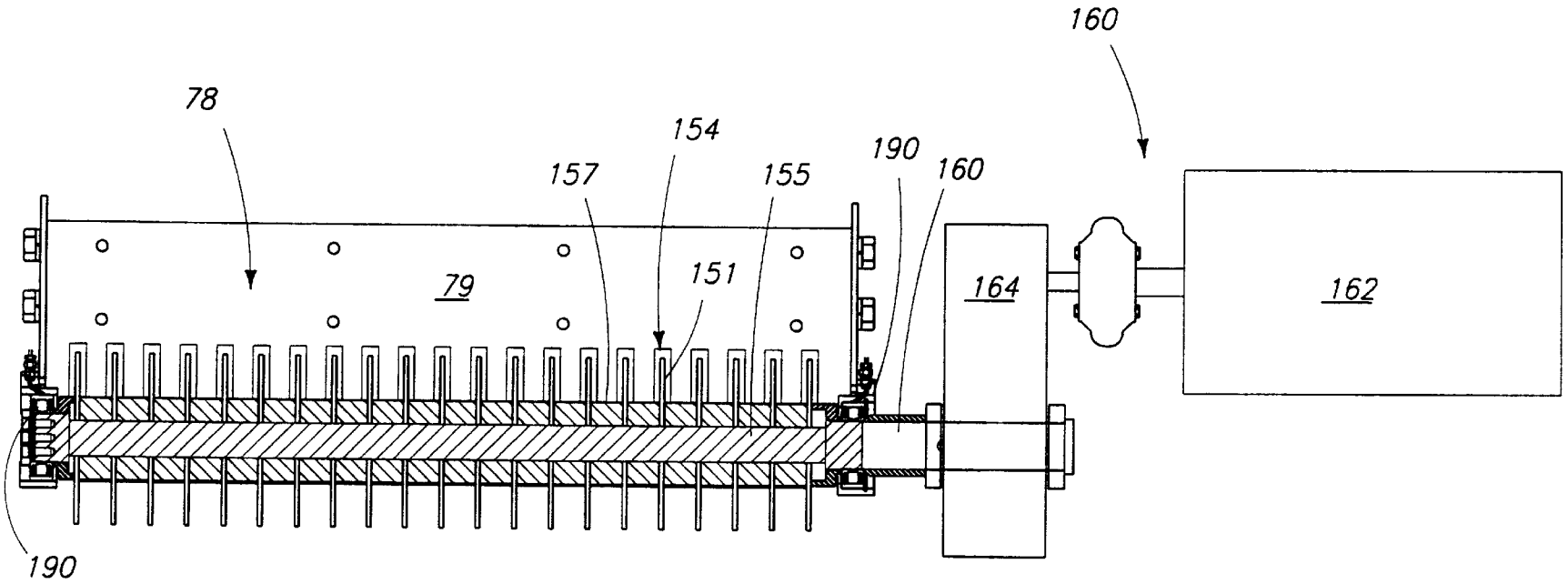

The separator screen 131 is mounted within the centrifugal fan housing 114 as illustrated in FIGS. 8, 11 and 12. The separator screen 131 is formed in an arcuate shape, and is mounted in the peripheral volute section 118 subdividing the section 118 into an inner volute chamber 133 and an outer volute chamber 135. The path of the airstream in the inner volute chamber 133 is illustrated by the path arrow 134. The path of the airstream in the outer volute chamber 135 is illustrated by the path arrow 136.

The centrifugal fan 112 has an outer volute duct 137 with a product outlet 139 for discharging the small particles **14*e* that have passed through the separator screen 131 from the centrifugal fan 112. Outer volute duct 137 forms a third airstream conduit for directing a portion of the airstream from apparatus 10 to discharge the small pieces from the apparatus via assist conveyor 170. Additionally, the centrifugal fan 112 has a recycle outlet 143 (see FIG. 8) associated with the inner volute chamber 133 for discharging the larger subdivided pieces 14*a*–14*d* that do not pass through the screen 131. The inner volute chamber 133 has an inner volute duct 141 (see FIG. 8) that is substantially tangent to the path of the blades 126 for directing a portion of the airstream from the fan through the recycle outlet 143. As previously mentioned, the blades 125 when rotated direct the air and the entrained subdivided pieces radially outward from the central inlet 120 to impinge against the screen 131 in a radial and tangential direction with the small pieces 14*e* passing through the screen 131 and the large pieces 14*a*–14*e* being deflected from the screen and carried by a portion of the airstream from the fan out through the inner volute duct 141**.

The inner volute duct 141 includes a recycle outlet 143 for discharging a portion of the airstream containing the entrained large pieces that do not pass through the separator screen 131.

The pneumatic conveyor/separator 110, besides the fan 112, further includes a removal conduit 148 extending between the outlet 96 of the outtake manifold 48 and the central inlet 120 of the centrifugal fan 12 as illustrated in FIGS. 2–6 and 8. The pneumatic conveyor 110 includes a recycle conduit 150 that extends between the recycle outlet 143 of the fan housing 114 and the recycle intake manifold section 92 and removal conduit 148 which serves as an intake pipe that extends between the outlet 96 adjacent outtake manifold 48 and central inlet 120 illustrated in FIGS. 6 and 8. Recycle conduit 150 forms a second airstream conduit for directing a portion of the airstream from screen 131 to shear intake manifold 46 (via recycle section 92) to recycle the large subdivided pieces back to the scissor shear rolls 42 and 44.

As illustrated in FIGS. 5 and 8, the cross-frame members 38 and 40 have notched stripping fingers 158 formed on an edge thereof projecting between the scissor rings 60 and into the inter-roll cavities along the lower profile of the scissor rolls 42 and 44 to strip any of the subdivided pieces from between the scissor rings 60 after the pieces have been severed.

During the operation of the apparatus 10, solid waste material 12 is fed into the apparatus 10 through the material entrance 32 and into the intake manifold 46 where it is directed to the scissor rolls 42 and 44 by servo feed roll 78. As the material engages the rolls, it is gripped by the finger knives 70 and pulled between the scissor rolls 42 and 44 with the scissor rings 60 and its shearing edges 68 shearing the solid waste material into subdivided pieces. As previously mentioned, the finger knives 70 grip the material, puncture the material and transversely cut the material as it passes between the rolls. The severed pieces 14*a*–14*e* then descend into the output manifold 48. The stripper fingers 158 strip any severed pieces from the rolls 42, 44 and into the outtake manifold 48.

The airstream created by the centrifugal fan 112 is directed through the outtake manifold 48 from the intake manifold 46 and the outlet 96 to entrain the subdivided pieces 14*a*–14*e* radially and tangentially outward against the arcuate separator screen 131 to cause those pieces 14 that are less than a predetermined size to pass through the screen into the outer volute chamber 136. Those subdivided pieces that are larger than the apertures or holes in the separator screen 131 are carried along the inside of the screen in the inner volute chamber 133 and out the inner volute duct 141 (FIG. 8). The recycle conduit 150 directs the airstream with the entrained large subdivided pieces into the recycle intake manifold section 92 for reprocessing and reduction through another pass of the scissor rolls 42 and 44. Screw-drive operation of screw conveyor 66 within outtake manifold 48 delivers the subdivided pieces to outlet 96 where they are drawn via airstream flow into centrifugal fan 112. The small pieces 14*e* that pass through the separator screen 131 are directed from the apparatus through the product outlet 139 to an assist pneumatic conveyor 170 for delivery to a final product outlet 176.

The large particles or pieces 14*a*–14*e* will be continually recycled until their size is reduced below that of the preselected size of the apertures of the separator screen 131. Screen 131 can be easily replaced in order to provide apertures with a desired size for implementing a desired sort of particles.

Figure 2:
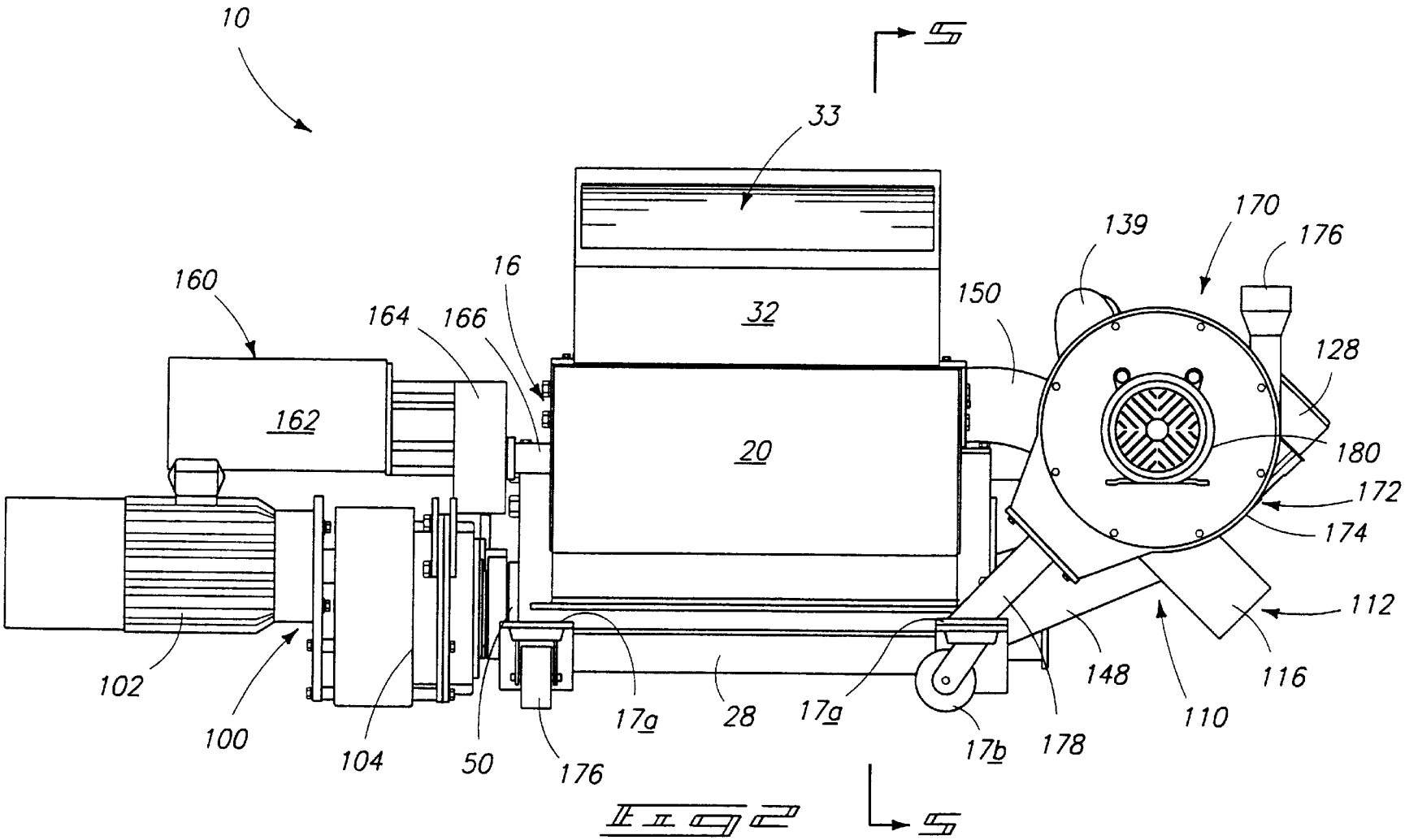
FIG. 2 is a front view of the apparatus illustrated in FIG. 1.
Figure 3:
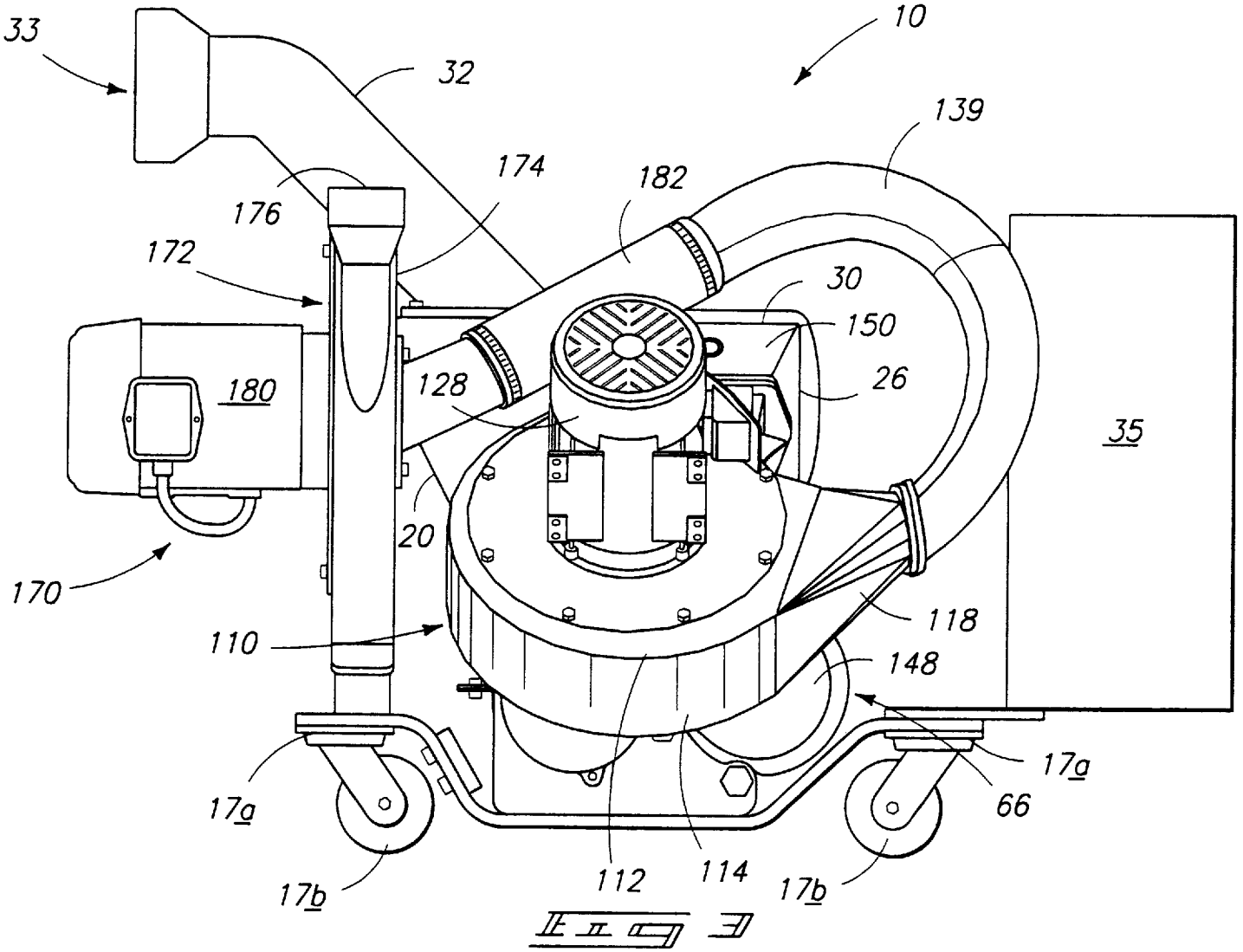
FIG. 3 is a side view of the apparatus illustrated in FIGS. 1 and 2.
Figure 4:
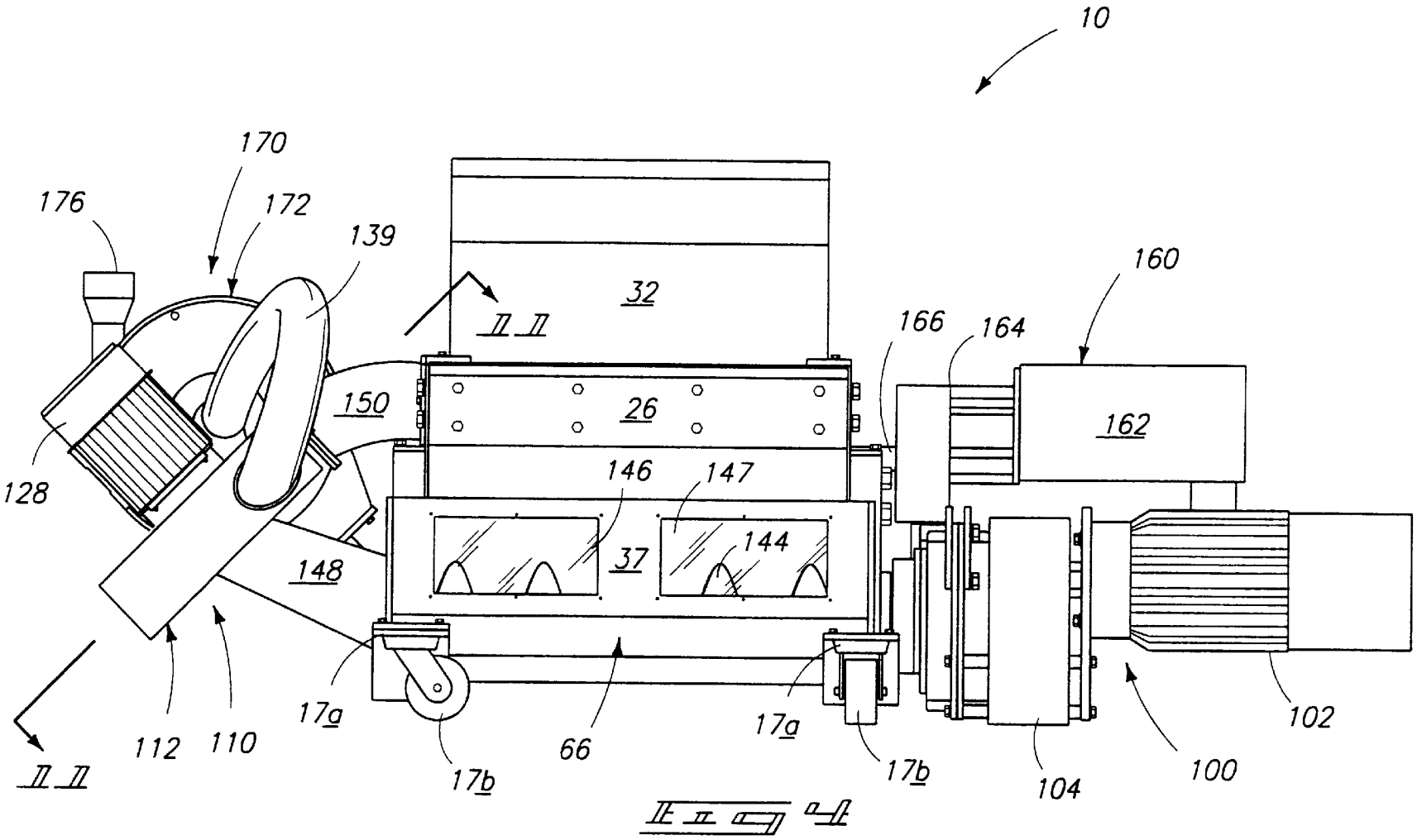
FIG. 4 is a back view of the apparatus taken along line 3—3 of is FIG. 1.

An auxiliary pneumatic conveyor 170 draws the subdivided and sorted pieces from product outlet 139 and enhances the airstream to further deliver the sorted pieces to a product outlet 176 with sufficient speed to convey the sorted pieces a substantial distance to a desired collection container. According to FIG. 8, conveyor 170 is constructed as a centrifugal fan 172 in a manner similar to fan 112 of conveyor 110, but without a separator screen 131. Hence, fan 172 has a propeller section 173 contained within a housing, as shown in FIG. 2. Sorted pieces are delivered to conveyor 170 via a central inlet 175. The pieces are then propelled via propeller section 173, leaving fan 172 via outer volute duct 177 and product outlet 176.

Servo motor driven feed roll 78 is formed from a plurality of gear rings 151 that are mounted for rotation on a hexagonal shaft 155 about axis 156 as shown in FIG. 8. A ring spacer 158 is mounted to shaft 155, between adjacent pairs of gear rings 151. Each gear ring 151 has a plurality of circumferentially spaced apart teeth 152 which pass through a corresponding slot 154 of a feed plate 79, according to FIGS. 5, 6 and 8. A web of scrap material 12 leaves a trim press (not shown) at a delivery, or line speed. Feed roll 78 is driven by a dedicated servo motor drive 160, via shaft 166 at substantially such line speed (see FIG. 14). Teeth 152 are sharp enough to perforate the sheet as it passes between gear rings 151 and feed plate 79, holding the sheet securely in place between gears 152 and plate 79, as shown in FIGS. 8–10. In this manner, servo feed roll 78 delivers the web of material at a desired line speed into scissor rolls 42 and 44 where it is shredded at a much higher feed rate. By perforating the web with perforations 15, as shown in FIGS. 7 and 9, and delivering it to rolls 42 and 44 in a speed regulated manner via feed roll 78, web 12 is not otherwise pulled on by rolls 40 and 42, which might otherwise place tension on web 12 that could interfere with operation of a trim press machine (or other processing machine) placed upstream of the apparatus of this invention. Furthermore, rolls 42 and 44 can be run at a speed that is optimal for shredding the material (most likely a higher speed), not for feeding the material (usually a lower speed), since feed roll 78 is operated to control the feed speed of the web into the apparatus. Hence, the apparatus of this invention can be run substantially at a desired line speed, preventing uneven or jerky feeding of a web of material into the apparatus.

Figure 6:
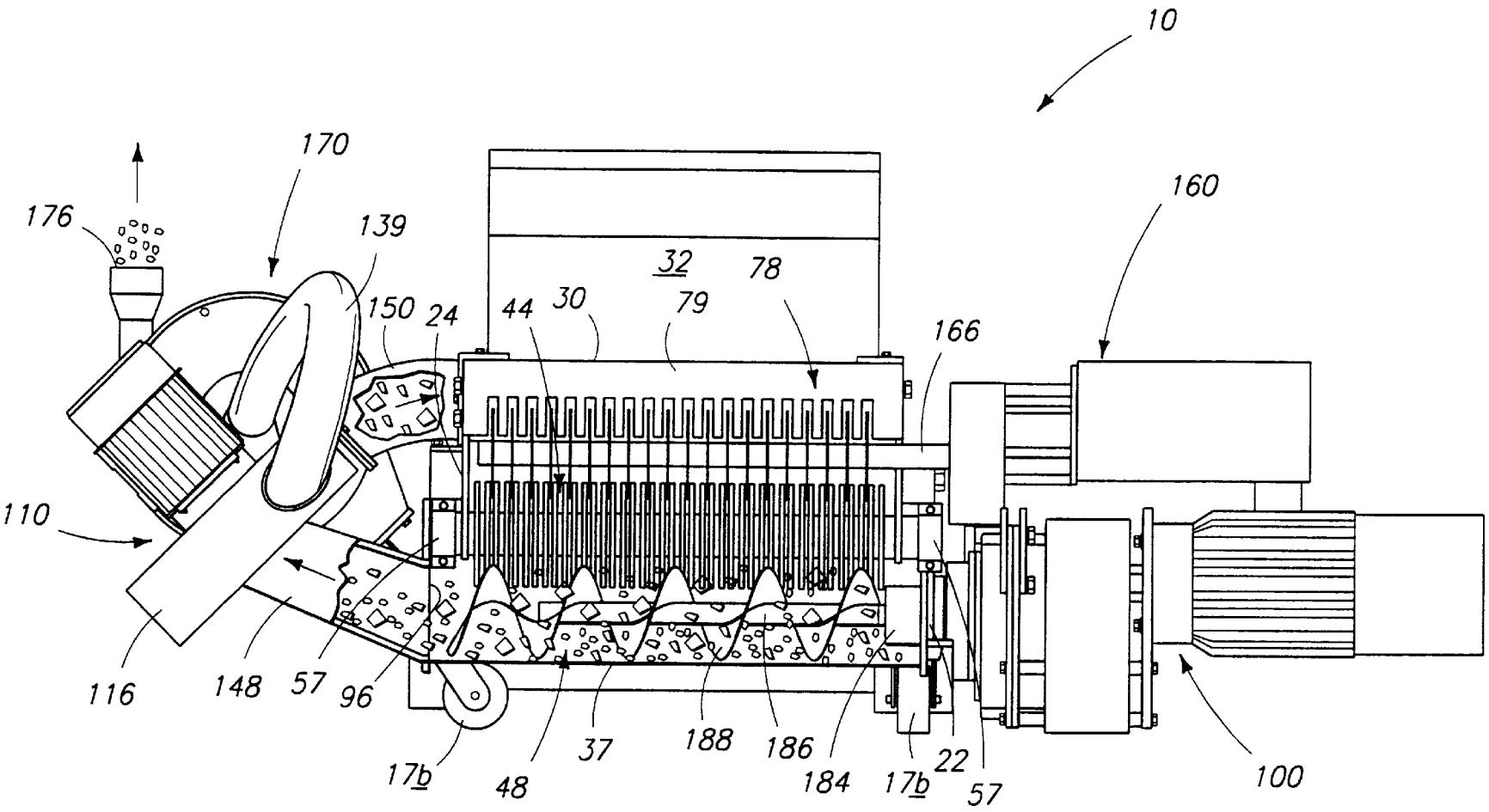
FIG. 6 is a longitudinal vertical partial breakaway view taken generally along line 3—3 in FIG. 1, but with selected broken away portions illustrating the interior of the apparatus.

Screw conveyor 66 delivers subdivided pieces that collect within outtake manifold 48 to outlet 96, as shown in FIGS. 6 and 8. Screw conveyor 66 is formed by a screw blade 188 carried on a central shaft 186. Shaft 186 is supported at a single end via a bearing 184, opposite from outlet 96. In this manner, the opposite end of shaft 186 presents blade 188 with a free-end that does not obstruct the delivery of subdivided pieces of waste material adjacent to outlet 96. Motor 102 and gearbox 104, in addition to driving scissor rolls 42 and 44, also drive screw conveyor 66, causing shaft 186 and blade 188 to rotate in a manner that delivers subdivided pieces out of bottom wall 28 of outtake manifold 48. Essentially, screw conveyor 66 behaves as an Archimedes screw for transporting collected pieces of material. Pneumatic conveyor 110 further draws the transported pieces from the vicinity of outlet 96 where they are sorted. A screw feed tray 37 forms a stationary delivery surface along which the pieces are drawn towards outlet 96 by rotation of screw 144 (formed by blade 188 and shaft 186), according to FIGS. 5, 6 and 8.

FIG. 14 depicts the coaction of servo motor driven feed roll 78 and feed plate 79. A plurality of slots 154 are formed in spaced apart relation within plate 79, each receiving a dedicated gear ring 151. Shaft 155 is supported for rotation at either end by a roller bearing assembly 190, with extension shaft 160 providing a feeder roll drive. Gearbox 164 connects servo motor 162 with shafts 160 and 155. Motor 162 is run via computer control at a desired speed to draw a web of material into the apparatus of this invention with a desired line speed, irrespective of the speed with which scissor rolls 42 and 44 are run. Preferably, motor 162 drives the web at a line speed of a process machine directly upstream of the apparatus of this invention. For example, feed roll 78 can be run to move a web at the same speed as a trim press which produces and feeds the web. Typically, a trim press would move a web intermittently. Similarly, feed roll 78 can be run at the same intermittent operating speed.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. An apparatus for comminute solid waste material into small pieces having a size less than a predetermined size, comprising:

a frame having an enclosure with an entrance for initially receiving a sheet of solid waste material;

a set of overlapping scissor rolls rotatably mounted within the enclosure for shearing the waste material into subdivided pieces when the material passes between the scissor rolls;

the entrance having:

(1) a shear intake manifold communicating with the entrance for receiving the solid waste material upstream of the scissor rolls and directing the waste material to the scissor rolls, and (2) a shear outtake manifold downstream of the scissor rolls for receiving the subdivided waste material pieces from the scissor rolls after the material has passed between the scissor rolls;

a feed roll rotatably carried by the frame for feeding the continuous sheet of waste material into the shear intake manifold at a desired line speed and directing the waste material to the scissor rolls;

a separator screen mounted on the frame downstream of the scissor rolls having a plurality of apertures corresponding to the predetermined size for permitting small subdivided pieces having a size less than the predetermined size to pass therethrough while preventing large subdivided pieces having a size greater than the predetermined size from passing therethrough; and a pneumatic conveyor including a fan for generating an airstream, a first airstream conduit to direct the airstream with entrained subdivided pieces from the shear outtake manifold to the separating screen, a second airstream conduit to direct a portion of the airstream from the screen to shear, intake manifold to recycle the large subdivided pieces back to the scissor shear rolls, and a screw delivery conveyor rotatably driven to assist the fan with discharging the small pieces from the apparatus and recirculating the large subdivided pieces;

the pneumatic conveyor mounted on the frame and configured to communicate with the shear outtake manifold, the screen, and the shear intake manifold for generating an airstream of sufficient velocity to:

(1) remove the subdivided pieces from the shear outtake manifold, (2) entrain the subdivided pieces in the airstream, (3) impinge the subdivided pieces against the screen to direct the small subdivided pieces through the screen, and (4) carry the large subdivided pieces away from the screen and into the shear intake manifold to recycle the large subdivided pieces through the scissor rolls to further reduce the size of the large subdivided pieces.

2. An apparatus for comminuting solid waste material into small pieces having a size less than a predetermined size, comprising:

a frame having an enclosure with an entrance for initially receiving a sheet of solid waste material;

a set of overlapping scissor rolls rotatably mounted within the enclosure for shearing the waste material into subdivided pieces when the material passes between the scissor rolls;

the entrance having:

(1) a shear intake manifold communicating with the entrance for receiving the solid waste material upstream of the scissor rolls and directing the waste material to the scissor rolls, and (2) a shear outtake manifold downstream of the scissor rolls for receiving the subdivided waste material pieces from the scissor rolls after the material has passed between the scissor rolls;

a feed roll rotatably carried by the frame for feeding the continuous sheet of waste material into the shear intake manifold at a desired line speed and directing the waste material to the scissor rolls;

a separator screen mounted on the frame downstream of the scissor rolls having a plurality of apertures corresponding to the predetermined size for permitting small subdivided pieces having a size less than the predetermined size to pass therethrough while preventing large subdivided pieces having a size greater than the predetermined size from passing therethrough; and a pneumatic conveyor mounted on the frame communicating with the shear outtake manifold, the screen, and the shear intake manifold for generating an airstream of sufficient velocity to:

(1) remove the subdivided pieces from the shear outtake manifold, (2) entrain the subdivided pieces in the airstream, (3) impinge the subdivided pieces against the screen to direct the small subdivided pieces through the screen, and (4) carry the large subdivided pieces away from the screen and into the shear intake manifold to recycle the large subdivided pieces through the scissor rolls to further reduce the size of the large subdivided pieces;

wherein the feed roll comprises a plurality of gear rings, each having gear teeth carried on a drive shaft, the gear teeth operable to intermesh with receiving slots of a feed plate to feed a web of material into the apparatus at the desired line speed.

3. An apparatus for comminuting solid waste material in to small pieces having a size less than a predetermined size, comprising:

a frame having an enclosure with an entrance for initially receiving a sheet of solid waste material;

a set of overlapping scissor rolls rotatably mounted within the enclosure for shearing the waste material into subdivided pieces when the material passes between the scissor rolls;

the entrance having:

(1) a shear intake manifold communicating with the entrance for receiving the solid waste material upstream of the scissor rolls and directing the waste material to the scissor rolls, and (2) a shear outtake manifold downstream of the scissor rolls for receiving the subdivided waste material pieces from the scissor rolls after the material has passed between the scissor rolls;

a feed roll rotatably carried by the frame for feeding the continuous sheet of waste material into the shear intake manifold at a desired line speed and directing the waste material to the scissor rolls;

a separator screen mounted on the frame downstream of the scissor rolls having a plurality of apertures corresponding to the predetermined size for permitting small subdivided pieces having a size less than the predetermined size to pass therethrough while preventing large subdivided pieces having a size greater than the predetermined size from passing therethrough;

a pneumatic conveyor mounted on the frame communicating with the shear outtake manifold, the screen, and the shear intake manifold for generating an airstream of sufficient velocity to:

(1) remove the subdivided pieces from the shear outtake manifold, (2) entrain the subdivided pieces in the airstream, (3) impinge the subdivided pieces against the screen to direct the small subdivided pieces through the screen, and (4) carry the large subdivided pieces away from the screen and into the shear intake manifold to recycle the large subdivided pieces through the scissor rolls to further reduce the size of the large subdivided pieces; and a screw conveyor for delivering subdivided pieces from the shear outtake manifold to the pneumatic conveyor.

4. The solid waste comminuting apparatus as defined in claim 3 wherein the screw conveyor comprises a motor driven Archimedes screw delivery device.

5. The solid waste comminuting apparatus as defined in claim 3 wherein the screw conveyor comprises a screw blade and a central support shaft for carrying the screw blade for rotation in a cantilevered free feed end configuration within the shear outtake manifold.

6. An apparatus for comminuting solid waste material into small pieces having a size less than a predetermined size, comprising:

a frame having an enclosure with an entrance for initially receiving the solid waste material;

a set of overlapping scissor rolls rotatably mounted within the enclosure for shearing the waste material into subdivided pieces when the material passes between the scissor rolls;

said entrance having:

(1) a shear intake manifold communicating with the entrance for receiving the solid waste material upstream of the scissor rolls and directing the waste material to the scissor rolls, and (2) a shear outtake manifold downstream of the scissor rolls for receiving the subdivided waste material pieces from the scissor rolls after the material has passed between the scissor rolls;

a separator screen mounted on the frame downstream of the scissor rolls having a plurality of apertures corresponding to the predetermined size for permitting small subdivided pieces having a size less than the predetermined size to pass therethrough while preventing large subdivided pieces having a size greater than the predetermined size from passing therethrough;

a pneumatic conveyor mounted on the frame communicating with the shear outtake manifold, the screen, and the shear intake manifold for generating an airstream of sufficient velocity to:

(1) remove the subdivided pieces from the shear outtake manifold, (2) entrain the subdivided pieces in the airstream, (3) impinge the subdivided pieces against the screen to direct the small subdivided pieces through the screen, and (4) carry the large subdivided pieces away from the screen and into the shear intake manifold to recycle the large subdivided pieces through the scissor rolls to further reduce the size of the large subdivided pieces; and a screw conveyor for delivering large and small subdivided pieces from the shear outtake manifold to the pneumatic conveyor.

7. The solid waste comminuting apparatus as defined in claim 6 further comprising a feed roll carried by the frame for feeding the waste material into the shear intake manifold at a desired line speed and directing the waste material to the scissor rolls.

8. The solid waste comminuting apparatus as defined in claim 7 wherein the feed roll is rotatably mounted within the shear intake manifold.

9. The solid waste comminuting apparatus as defined in claim 7 further comprising a servo motor and a gearbox coupled with the feed roll to drive the feed roll at a desired line speed.

10. The solid waste comminuting apparatus as defined in claim 7 wherein the feed roll comprises a plurality of gear rings, each having gear teeth carried on a drive shaft, the gear teeth operable to intermesh with receiving slots of a feed plate to feed a web of material into the apparatus at the desired line speed.

11. The solid waste comminuting apparatus as defined in claim 6 wherein the screw conveyor comprises a motor driven Archimedes screw delivery device.

12. The solid waste comminuting apparatus as defined in claim 6 wherein the screw conveyor comprises a screw blade and a central support shaft, the central support shaft configured to carry the screw blade for rotation in a cantilevered and free feed end configuration within the shear outtake manifold.

13. The solid waste comminuting apparatus as defined in claim 6 wherein the pneumatic conveyor includes:

a fan for generating the airstream;

a first airstream conduit to direct the airstream with entrained subdivided pieces from the shear outtake manifold to the separating screen;

a second airstream conduit to direct a first portion of the airstream from the screen to the shear intake manifold to recycle the large subdivided pieces back to the scissor shear rolls;

a third airstream conduit to direct a second portion of the airstream from the apparatus to discharge the small pieces from the apparatus.

14. The solid waste comminuting apparatus as defined in claim 13 wherein the fan includes:

an inlet operatively connected to the first airstream conduit;

a first outlet operatively connected to the second airstream conduit;

a second outlet operatively connected to the third airstream conduit;

a fan blade assembly positioned between the inlet and the second and third outlets for generating the airstream of the sufficient velocity; and wherein the screen is positioned between the fan blade assembly and the second outlet to separate the small pieces and the large pieces.

15. An apparatus for communicating solid waste material, comprising:

a frame having an enclosure with an entrance for initially receiving solid waste material;

a set of overlapping scissor rolls rotatably mounted within the enclosure for shearing the waste material into subdivided pieces when the material passes between the scissor rolls;

a feed roll rotatably carried by the frame for feeding an elongate sheet of waste material into the shear intake manifold at a desired line speed and directing the waste material to the scissor rolls;

a conveyor configured to carry sheared large and small subdivided pieces from downstream of the scissor rolls for sorting, a separator screen mounted on the frame downstream of the scissor rolls having a plurality of apertures corresponding to the predetermined size for permitting small subdivided pieces having a size less than the predetermined size to pass therethrough while preventing large subdivided pieces having a size greater than the predetermined size from passing therethrough; and a screw conveyor for delivering subdivided pieces from the shear outtake manifold to the pneumatic conveyor;

wherein the entrance has:

(1) a shear intake manifold communicating with the entrance for receiving the solid waste material upstream of the scissor rolls and directing the waste material to the scissor rolls; and (2) a shear outtake manifold downstream of the scissor roll for receiving the subdivided waste material pieces from the scissor rolls after the material has passed between the scissor rolls and wherein the conveyor comprises a pneumatic conveyor mounted on the frame communicating with the shear outtake manifold, the screen, and the shear intake manifold for generating an airstream of sufficient velocity to:

(a) remove the subdivided pieces from the shear outtake manifold, (b) entrain the subdivided pieces in the airstream, (c) impinge the subdivided pieces against the screen to direct the small subdivided pieces through the screen, and (d) carry the large subdivided pieces away from the screen and into the shear intake manifold to recycle the large subdivided pieces through the scissor rolls to further reduce the size of the large subdivided pieces.

* * * * *

UNITED STATES PATENT AND TRADEMARK OFFICE

CERTIFICATE OF CORRECTION

PATENT NO. : 5,860,607

DATED : January 19, 1999

INVENTOR(S) : Jere F. Irwin

It is certified that error appears in the above-identified patent and that said Letters Patent is hereby corrected as shown below:

Column 1, lines 22-23: Delete "PCT/US94106412" and insert --PCT/US94/06412--.

Column 6, line 67: After "inter-roll cavities", insert --86--.

In the Claims:

Column 9, line 4 (Claim 1): Delete "comminute" and insert --comminuting--.

Column 9, line 38 (Claim 1): After "shear" and before "intake", delete the comma (,).

Column 10, lines 41-42 (Claim 3): Delete "material in to" and insert --material into--.

Signed and Sealed this

Sixth Day of July, 1999

*Attest:*

Q. TODD DICKINSON

*Attesting Officer*

*Acting Commissioner of Patents and Trademarks*